United States Patent [19]

Heintzmann et al.

[11] Patent Number: 4,586,530

[45] Date of Patent: May 6, 1986

[54] ARRANGEMENT FOR SUPPLYING OF CONSUMERS WITH PRESSURE FLUIDS

[75] Inventors: Peter Heintzmann, Bochum; Manfred Koppers, Duisburg; Karlheinz Bohnes, Bochum; Rolf-Peter Smektala, Marl, all of Fed. Rep. of Germany

[73] Assignee: Bochumer Eisenhutte Heintzmann GmbH & Co. KG, Bochum, Fed. Rep. of Germany

[21] Appl. No.: 671,431

[22] Filed: Nov. 13, 1984

[30] Foreign Application Priority Data

Nov. 11, 1983 [DE] Fed. Rep. of Germany ..... 3340815

[51] Int. Cl.[4] ..... F16K 43/00

[52] U.S. Cl. ..... 137/322; 251/145; 251/149.3

[58] Field of Search ..... 251/149.3, 149.7, 246, 251/279, 145; 137/322, 580

[56] References Cited

U.S. PATENT DOCUMENTS

| | | | |
|---|---|---|---|
| 195,049 | 9/1877 | Robinson | 251/149.3 |
| 200,944 | 3/1878 | Smith | 251/149.3 |
| 1,858,766 | 5/1932 | Dubroski | 251/149.3 |
| 3,195,562 | 7/1965 | Nelson et al. | 137/322 |
| 3,620,250 | 11/1971 | Wiecle | 251/145 |

*Primary Examiner*—A. Michael Chambers

*Attorney, Agent, or Firm*—Michael J. Striker

[57] ABSTRACT

An arrangement for supplying consumers, particularly mobile consumers, with pressure fluids such as pressure air or pressure liquid, particularly in underground excavations, has a composite rail track for guiding a pressure fluid, a plurality of nipples arranged at a predetermined distance from one another in the longitudinal direction of the rail track, and at least one fluid withdrawing unit which cooperates with the nipples to open the latter and has a length selected with respect to the distance between two neighboring nipples so that one nipple is always located in the effective region of the withdrawing unit to be opened by the latter.

11 Claims, 7 Drawing Figures

ARRANGEMENT FOR SUPPLYING OF CONSUMERS WITH PRESSURE FLUIDS

BACKGROUND OF THE INVENTION

The present invention relates to an arrangement for supplying consumers, particularly mobile consumers, with pressure fluids.

Supply of mobile consumers with pressure fluids, especially in underground excavations, whether it is a pressure air or a hydraulic liquid, is always connected with difficulties when the action radius of the consumer is relatively great. One possibility of supplying includes, for example, the introduction of pressure storages forming energy reservoirs. Depending upon the storage volume and air consumption, the consumer can have a respective active region within a predetermined action time. After this, the storage must be changed or recharged with respective time consumption in stationary positions. In addition to these disadvantages, there is also another disadvantage that for a substantially satisfactory action radius, a storage with a great volume must be provided for the consumer, so that its transportation capacity is naturally limited.

As long as the action radius of a consumer is limited, the utilization of flexible dragging conduits can be taken into consideration. There is here, however, the danger that especially with long dragging conduits and poor operational conditions, the dragging conduits are damaged or completely destroyed, which leads to stoppage of an operation. If the action region of the consumer must be expanded, the dragging conduits must be uncoupled. Such an exchange on situ is however always connected with high expenses for the uncoupling of the dragging conduits and subsequent coupling of them.

Moreover, there are many rail systems which provide for a possibility to supply an air consumer with energy over the length of the rail region. These systems have certain problems at the connection points of the rail portions to form the rail track in the sense of leakage losses or factual situations so that no energy withdrawal is here possible. As a result of this, the used length of these systems is also limited.

The latter described air rail systems includes such a system in which a plurality of nipples is provided at distances from one another on a rail track, and a withdrawing carriage is displaceable on the rail track from one nipple to the other. The nipples are formed as magnet valves. When a withdrawal carriage is located at the respective nipple, the permanent magnet provided in the withdrawing carriage is placed in such position that the magnet valve in the rail track is opened. In this withdrawing position, the withdrawing carriage cannot move. On the other hand, no air withdrawal is possible when the withdrawing carriage is located between two nipples. Moreover, the positioning of the withdrawing carriage requires a manual actuation for a withdrawing conduit. An automatic continuous energy withdrawal of a great action radius is not possible here.

SUMMARY OF THE INVENTION

Accordingly, it is an object of the present invention to provide an arrangement for supplying consumer, particularly mobile consumers, with pressure fluids, such as pressure air or pressure liquid, which avoids the disadvantages of the prior art.

More particularly, it is an object of the present invention to provide an arrangement of the abovementioned type which is improved so that it has a simpler construction and a higher leakage tightness and at the same time the respective consumer can be supplied with pressure fluid over a greater system length in each operative position in an uninterrupted manner.

In keeping with these objects and with others which will become apparent hereinafter, one feature of the present invention resides, briefly stated, in a supplying arrangement having a rail track for guiding a pressure fluid, a plurality of nipples arranged along the rail track at a distance from one another, and at least one withdrawing unit movable over the rail track and acting upon the nipples, wherein the length of the withdrawing unit and the distance between two neighboring nipples are selected so that one nipple is always located in automatically unlocking region of the withdrawing unit.

The determination of the length of the withdrawing unit relative to the distance between two neighboring nipples provides for a possibility to continuously withdraw pressure fluid from the rail track. Since always one nipple is located in the respective active region of the withdrawing unit which provides for the automatic unlocking of the nipple, pressure fluid can be withdrawn continuously, regardless of the fact whether the consumer moves or does not move. The withdrawing unit can be formed as a component of the consumer. On the other hand it can be coupled with the consumer in any manner.

The invention is especially advantageous for the use in underground excavations. It can supply both excavation machines and transporting devices in mine face and gallery continuously with pressure fluids. The action radius of the consumer is almost unlimited. Time losses for coupling are dispensed with. Damages to the rail track and the withdrawing unit do not lead to a function loss. Both structural elements can be formed sturdy so as to advantageously satisfy the requirements made with respect to the underground excavations. The supply arrangement in the sense of the rail track and the withdrawing unit can have such a small cross-sectional dimension that it can extend in even very narrow mine spaces and in poor spatial conditions.

In accordance with an advantageous embodiment of the present invention, the rail track is tubular and the withdrawing unit completely encloses the tubular rail track and advantageously has a cylindrical shape. The tubular form of the rail track, particularly the round cross section, as well as the cylindrical design of the withdrawing unit which completely surrounds the rail track, provide for the possibility to have a very slim construction with respective flexibility, so that there are no problems during displacement on curves, through depressions or over passages. It is also possible to provide sealing of the rail track and the withdrawing element with conventional sealing elements. No special constructions are necessary. Since the withdrawing unit is guided directly on the rail track, no additional guiding conduits and the like are necessary. The tubular form is maintenance-favorable and also damage-resistant as long as the withdrawing unit slides with a great play on the rail track.

A further feature of the present invention is that the nipples or valves are arranged under the action of a pair of radially displacing plungers which are connected with one another so as to form a kind of a scale balance and extend outwardly beyond the periphery of the rail track. The plungers cooperate with inclined surfaces in end portions of the withdrawing unit and thereby act on the nipples. With this construction it is guaranteed that a nipple opens first when it is separated by the withdrawing unit in both movement directions. The unlocking plungers are arranged before and after each nipple as considered in the longitudinal direction of the rail track. Because of its scale balance-like coupling, they can displace under the action of the inclined surfaces in the end portions of the withdrawing unit both relative to one another, and also relative to the valve plunger of the nipple or valve. It is therefore guaranteed that a radial displacement of the valve plunger and thereby opening of the nipple is possible only when both unlocking plungers extend parallel and the valve plunger is driven. In the closing position, the free ends of the unlocking plunger extend outwardly beyond the periphery of the rail track so that by the contact with the inclined surfaces of the withdrawing unit a radial displacement in the desired periphery can take place. The position of the unlocking plungers is radially adjustable.

When one inclined surface of the withdrawing unit reaches a nipple, the inclined surface first radially displaces one unlocking plunger. Therefore, the traverse which connects the unlocking plungers with one another turns about its pivot point on the valve plunger, without however radially displacing the latter. When the withdrawing unit moves further, then because of the respective design in the interior of the withdrawing unit it is guaranteed that the radial position of the radially inwardly displaced unlocking plunger is maintained. When then after passing the nipple, also the second unloading plunger is brought in contact with the inclined surfaces, it is also displaced radially inwardly. Now the valve plunger is driven since as described hereinabove, the unlocking plunger which has been first displaced radially inwardly can no longer extend outwardly beyond the rail track. The nipple is opened via the traverse. The distance between the unlocking plungers is so dimensioned relative to the respective nipple, that the valve plunger is displaced with reliability radially only when the sealing for the rail track provided in the withdrawing unit is pressed by the nipple.

This selection of the nipple and the opening characteristic allows a local drawing off of the pressure fluid. For this purpose the respective withdrawing device must be formed so that simultaneously both unlocking plungers associated with one nipple are displaced radially inwardly so that thereby the nipple is opened.

For guaranteeing unobjectionable actuation of the unlocking plungers also during relative rotation of the withdrawing unit on the rail track, the inclined surfaces are formed as components of funnel-shaped recesses provided in the end sides of the withdrawing unit.

Still a further feature of the present invention is that the withdrawing unit is provided with a withdrawing chamber located between the funnel-shaped recesses and sealed therefrom, and a plurality of supporting members surrounding the rail track are arranged in the withdrawing chamber. The thus arranged supporting members are provided to function so as to hold the radially inwardly displaced unlocking plungers in their position, so that in the withdrawing chamber there is always pressure fluid which can be supplied to the respective consumer.

Yet another feature of the present invention is that the supporting members are formed as convolutions of a helical spring arranged in the withdrawing chamber. The helical spring surrounds with the required play the rail track and is embedded at its end in respectively shaped chambers in the withdrawing unit.

Instead of the helical springs, the supporting members can be formed as a plurality of rings arranged near one another and holding the radially inwardly displaced unlocking plungers in their position. Both the rings and also the helical springs guarantee that the withdrawing unit can be moved on a curved rail track without affecting the withdrawing functions.

The manufacture and mounting of the inventive supply arrangement is simplified and facilitated when in accordance with another feature of the present invention the nipples together with the unlocking plungers are formed as components of short tubular portions which are sealingly and releasably incorporated in the rail track.

Finally, the withdrawing unit can be formed rigid or composed of flexible material. Both possibilities provide for adjustment, in connection with the supporting members arranged in the interior of the withdrawing unit, to a strongly curved portions of the rail track.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
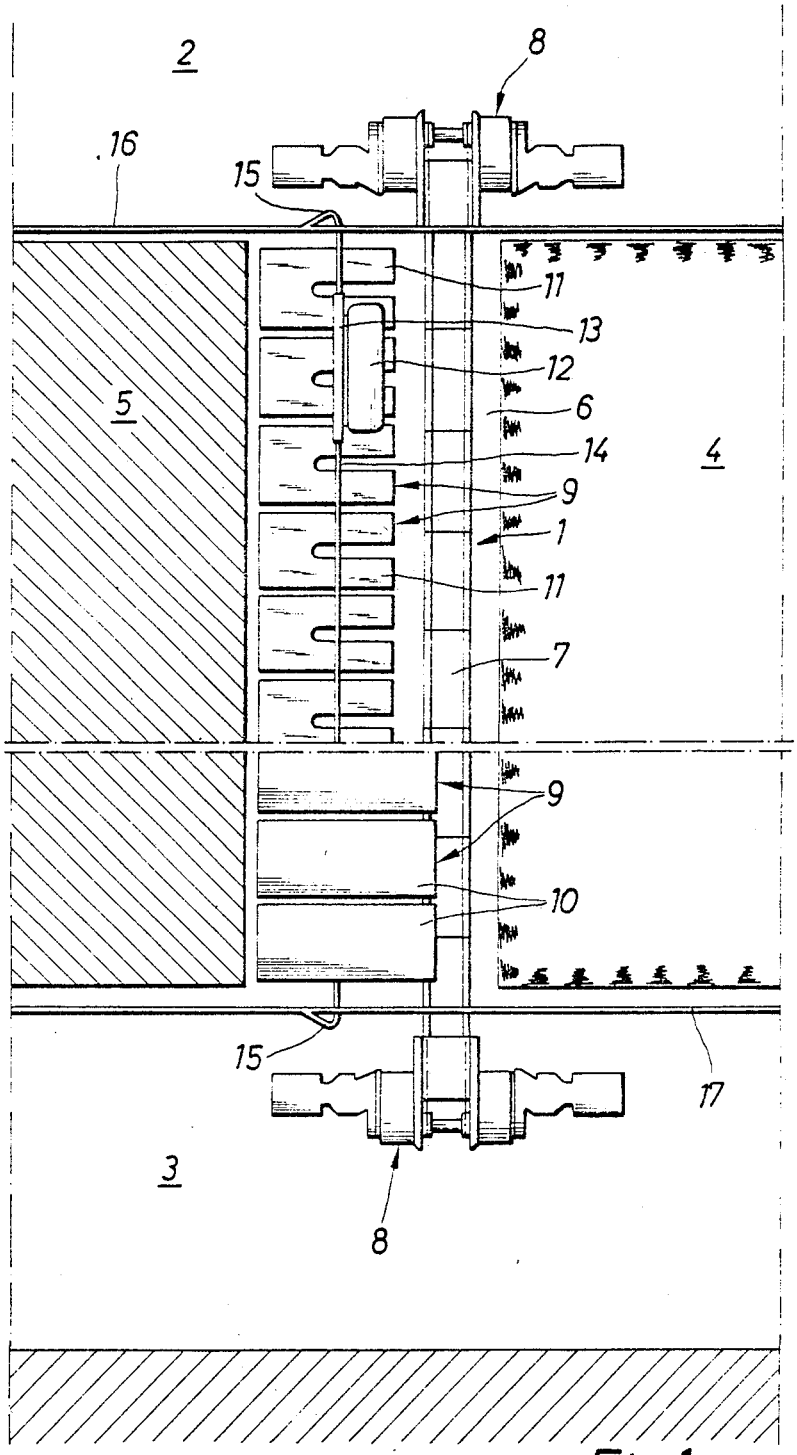
FIG. 1 is a view showing a horizontal longitudinal section of a mine face with two connected galleries in an underground excavation, with roof supporting units, a face conveyor, and an access device on a plan view.

FIG. 1 shows a face 1 of an underground pit mine with two galleries 2 and 3 connected with one another.

Reference numeral 4 identifies coal to be removed, whereas reference numeral 5 identifies a mine field from which coal has been already removed.

A face conveyor 7 extends in the longitudinal direction of the face along a face of working 6. Driving stations 8 of the face conveyor 7 lie in the galleries 2 and 3. An extraction machine can be guided on the face conveyor 7. The face space 1 is retained open by mine roof supports 9 arranged near one another. The mine roof supports have roof caps 10 located under the cutting lines in the plane view, and floor beams 11 located above the cutting lines in the plan view.

The mine roof supports 9 also serve for protection of an access arrangement 12 for transporting personnel and materials. The access arrangement 12 is associated with a withdrawal unit 13 which is forcedly moved on a rail track 14 extending in the longitudinal direction of the face 1 and connected via a connecting band 15 with pressure air supply conduits 16 and 17 located in the galleries 2 and 3.

Figure 2:
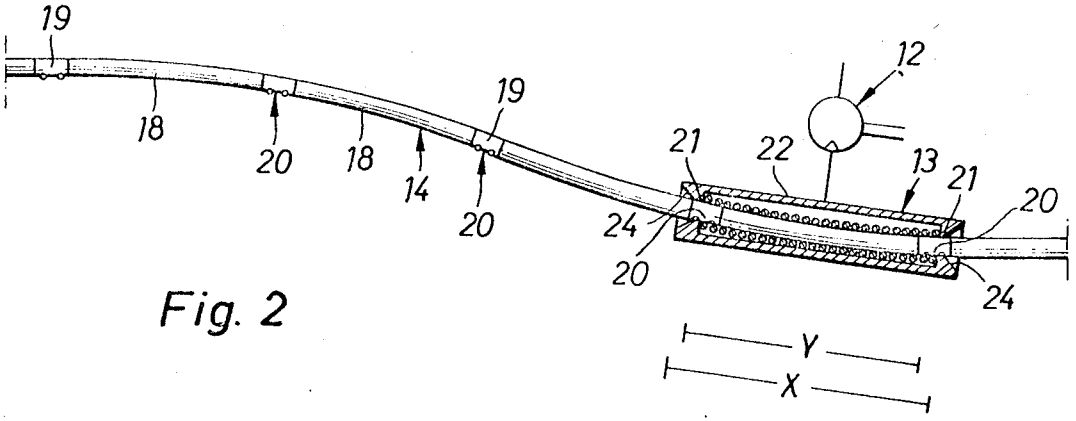
FIG. 2 is a view showing a longitudinal section of a rail track which guides a pressure fluid and provided with a withdrawing unit, in a vertical longitudinal section on an enlarged scale.

As can be seen from FIG. 2, the rail track 14 is composed of individual rail portions 18, as well as short tubular portions 19 provided with plugs 20 for pressure air and incorporated between the rail portions. The tubular portions 19 and the rail portions 18 are assembled with one another tightly, but releasably. The withdrawal unit 13 for pressure air, which is guided on the rail track 14 has seals 21 at its both ends. The length X of the withdrawal unit 13 between the seals 21 is dimensioned relative to the distance Y between two successive plugs 20 so that only one plug 20 is located in the region of action of the withdrawing unit 13. The consumer 12 is shown schematically in FIG. 2.

Figure 3:
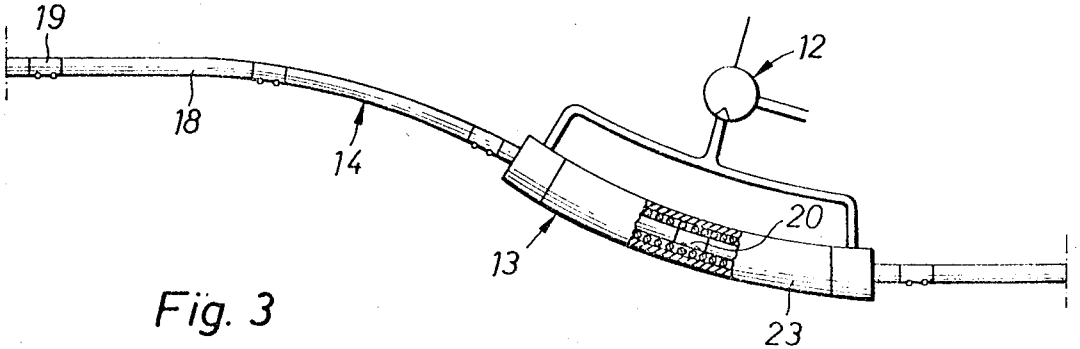
FIG. 3 is a view substantially corresponding to the view of FIG. 2, but showing another embodiment of the withdrawing unit guided on the rail tracks, partially in section.

In FIG. 2 the withdrawing unit 13 has a substantially rigid housing 22. In contrast, withdrawing unit 13 in FIG. 3 has a housing 23 of flexible material, such as for example, rubber. Both housings 22 and 23 are formed so that the rail track 14 can be strongly bent without affecting the continuous withdrawl of pressure air. The housing has an elongated cylindrical shape.

Figure 4:
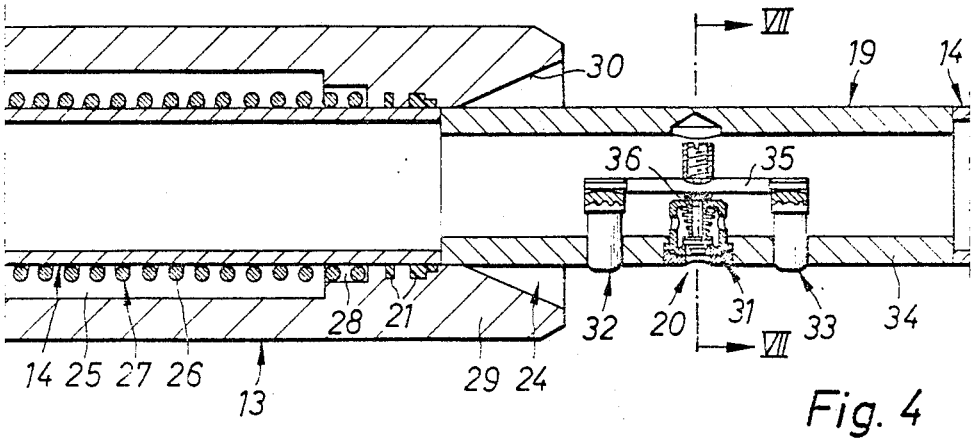
FIG. 4 is a view showing a longitudinal section of the rail track and the withdrawing unit of FIG. 2 in vertical longitudinal section on an enlarged scale.
Figure 5:
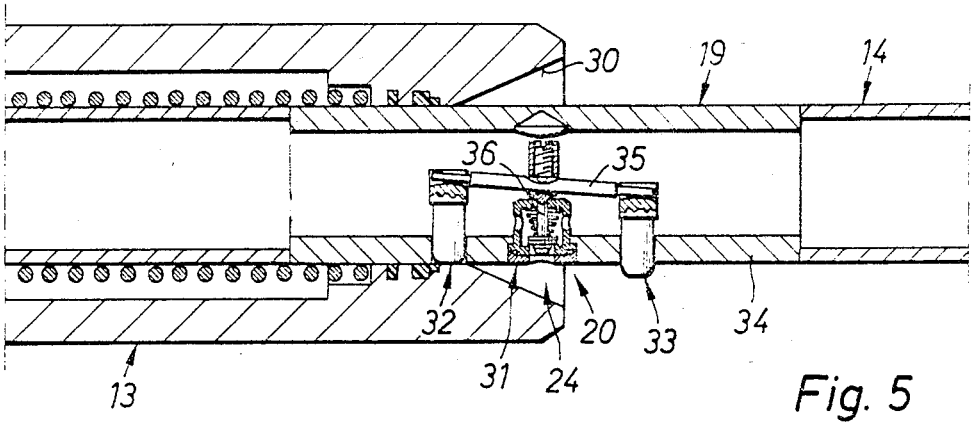
FIG. 5 is a view substantially corresponding to the view of FIG. 4 but with the displaced withdrawing unit.
Figure 6:
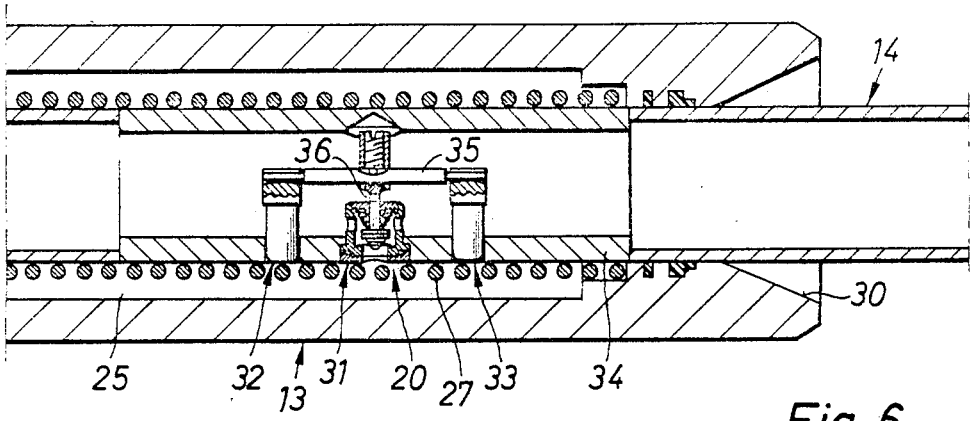
FIG. 6 is a view substantially corresponding to the views of FIGS. 4 and 5, with the withdrawing unit displaced further.

FIG. 2 in connection with FIGS. 4–6 shows that each withdrawing unit 13 has funnel-shaped recesses 24 at its ends, and a withdrawal chamber 25 sealed with respect to the recesses 24. Supporting members 26 which surround the rail track 14 extend in the longitudinal direction of the withdrawal chamber 25. In the shown embodiment the supporting members 26 are formed as convolutions of a helical spring 27. The helical springs 27 embrace the rail track 14 which is tubular and are fixed in chambers 28 provided in the vicinity of the seals 21.

The funnel-shaped recesses 24 in end portions 29 of the withdrawing units 13 form inclined surfaces 30. These inclined surfaces cooperate with the plugs 20 in the tubular portions 19, as will be explained hereinbelow.

As can be seen from FIGS. 4–7, each plug 20 has a fluid nozzle 31. The fluid nozzle 31 cooperates with a pair of plungers 32 and 33 which are spaced from one another in a longitudinal direction of the rail track, connected with one another in a scale balance-like manner, and project beyond the periphery of the rail track 14. The plunger 32 and 33 are displaceable by the inclined surfaces 30 radially toward the axis of the rail track and act upon the nozzle 31 in unlocking manner. The plungers 32 and 33 are supported in a wall 34 of the short tubular portion 19. At their rear side, the plungers 32 and 33 are supported spatially hingedly on a traverse 35, which in turn is centrally supported on a valve plunger 36 also spatially hingedly. The traverse 35 is fixed by an adjusting screw 37 in its position on the valve plunger 36.

Figure 7:
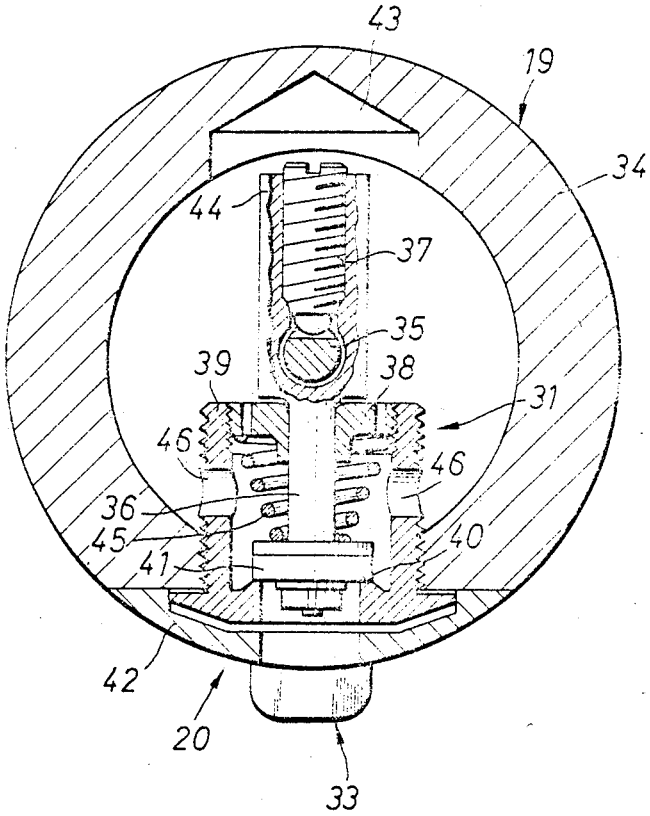
FIG. 7 is a view showing an enlarged vertical section of the rail track taken along the line VII—VII in FIG. 4.

As can be particularly recognized from FIG. 7, the valve plunger 36 is arranged in an insert 38 of a valve housing 39 provided with a sealing seat 40 for a closing body 41. The valve housing 39 is advantageously screwed into the tubular portion 19. A cap 42 is formed in correspondence with the contour of the tubular portion 19. A recess 43 in the wall 34 of the tubular portion 19 serves for receiving an end portion 44 of the valve plunger 36 when it is displaced radially. A spring 45 presses the closing body 41 against the sealing seat 40. Opening 46 in the valve housing 39 connects the interior of the valve housing 39 with the interior of the tubular portion 19.

FIG. 4 shows a position of a withdrawing unit 13 at a distance from a nipple 31. Both unlocking plungers 32 and 33 extend only insignificantly beyond the periphery of the tubular portion 19.

When the withdrawing unit 13 is moved further, the wall of the funnel-shaped recess 29 which forms the inclined surface 30, presses the first unlocking plunger 32 radially inwardly whereby the traverse 35 turns about a hinge point on the valve plunger 36. The unlocking plunger 33 located behind the nipple 31 extends thereby somewhat further out of the tubular portion 19. This situation is shown in FIG. 5. Since the traverse 35 can turn, the valve plunger 36 does not move radially. First when in accordance with FIG. 6 the withdrawing unit 13 is displaced still further, and the inclined surface 30 displaces radially inwardly the unlocking plunger 36 which is rear in the movement direction of the withdrawing unit 13, the traverse 35 is thereby displaced and the valve plunger 36 is moved. The valve 31 opens and pressure air can flow from the rail track 14 into the withdrawal chamber 25 in the withdrawing unit 13. From here, the pressure fluid is supplied to the consumer 12. The radial inwardly pressed position of the unlocking plungers 32 and 33 is maintained by the convolutions 26 of the helical spring 27.

When the unlocking plunger 32 at the other end of the receiving unit 13 reaches in the inlet region the inclined surface 30 located therein, it is pressed radially outwardly by the spring 45 via the valve plunger 36 and the traverse 35, and the closing body 31 is again pressed against the sealing seat. Thereby, the withdrawal process for this nozzle 31 is finished.

It will be understood that each of the elements described above, or two or more together, may also find a useful application in other types of constructions differing from the types described above.

While the invention has been illustrated and described as embodied in an arrangement for supplying consumers, particularly mobile consumers, with pressure fluids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for supplying consumers, particularly mobile consumers, with pressure fluids such as pressure air or pressure liquid, preferably in undergound excavations, comprising a rail track arranged to guide a pressure fluid and having a longitudinal axis; a plurality of nipples arranged on said rail track at a plurality of locations spaced from one another by predetermined distances in a longitudinal direction of said rail track; at least one fluid withdrawing unit movable on said rail track and cooperating with said nipples so as to open the latter, said fluid withdrawing unit having a length which is selected with respect to the distance between two of said nipples so that one of said nipples is always located in the region of said withdrawing unit so as to provide automatic opening of said nipple; and a plurality of pairs of plungers each associated with a respective one of said nipples and each having two plungers which are spaced from one another in the longitudinal direction of the rail track, connected with one another in a scale balance-like manner, and extending beyond a periphery of said rail track, each of said plungers being formed to act on the respective one of said nipples so as to unlock the latter.

2. An arrangement as defined in claim 1, wherein said rail track includes a plurality of portions located after one another in the longitudinal direction of the rail track and connected with one another.

3. An arrangement as defined in claim 1, wherein each of said withdrawing units has two end portions provided with inclined surfaces which act on said plungers so as to displace the latter radially toward said axis of said rail track for unlocking respective one of said nipples.

4. An arrangement as defined in claim 3, wherein each of said end portions of said withdrawing unit has a funnel-shaped recess which forms a respective one of said inclined surfaces.

5. An arrangement as defined in claim 4, wherein said withdrawing unit has a withdrawing chamber located between said funnel-shaped recesses and sealed with respect to the latter.

6. An arrangement as defined in claim 5, wherein said withdrawing unit has a plurality of supporting members spaced from one another in the longitudinal direction of said rail track and arranged in said withdrawal chamber.

7. An arrangement as defined in claim 6, wherein said supporting members are formed as convolutions of a helical spring located in said withdrawal chamber.

8. An arrangement as defined in claim 6, wherein said supporting members are formed by a plurality of rings located near one another in said withdrawal chamber.

9. An arrangement as defined in claim 1, wherein said rail track includes a plurality of main portions and a plurality of short tubular portions located therebetween, said tubular portions being tightly connected with said main portions and at the same time being releasable therefrom, said nipples together with said plungers being formed as components of said short tubular portions of said rail track.

10. An arrangement as defined in claim 1, wherein said withdrawing unit is formed as a substantially rigid unit.

11. An arrangement as defined in claim 1, wherein said withdrawing unit is formed of substantially flexible material.

* * * * *